US008734209B2

(12) United States Patent
Burns et al.

(10) Patent No.: US 8,734,209 B2
(45) Date of Patent: May 27, 2014

(54) CHIMNEY CAP

(75) Inventors: Sean D. Burns, Lakeville, MN (US); William A. Dalsin, Lakeville, MN (US)

(73) Assignee: Bernard Dalsin Manufacturing Company, Farmington, MN (US)

( * ) Notice: Subject to any disclaimer, the term of this patent is extended or adjusted under 35 U.S.C. 154(b) by 1923 days.

(21) Appl. No.: 11/364,277

(22) Filed: Feb. 27, 2006

(65) Prior Publication Data

US 2007/0202790 A1 Aug. 30, 2007

(51) Int. Cl.
*F23J 13/08* (2006.01)

(52) U.S. Cl.
USPC ..... 454/4; 454/12

(58) Field of Classification Search
USPC ..... 454/4, 12
See application file for complete search history.

(56) References Cited

U.S. PATENT DOCUMENTS

| | | | | | |
|---|---|---|---|---|---|
| 483,619 | A | * | 10/1892 | Oldershaw | 454/14 |
| 2,718,900 | A | * | 9/1955 | Nutter | 137/512.1 |
| 3,269,296 | A | * | 8/1966 | Best | 454/12 |
| 4,200,038 | A | | 4/1980 | Briner et al. | |
| 4,334,460 | A | | 6/1982 | Simmons et al. | |
| 4,470,399 | A | * | 9/1984 | Pitha | 126/523 |
| 4,478,208 | A | * | 10/1984 | Pitha | 126/500 |
| 4,534,280 | A | * | 8/1985 | Hisey | 454/14 |
| 4,535,686 | A | | 8/1985 | Hisey | |
| 4,549,473 | A | | 10/1985 | Alexander et al. | |
| 4,616,457 | A | | 10/1986 | Yoder et al. | |
| 4,732,078 | A | | 3/1988 | Giumenta et al. | |
| 5,025,712 | A | * | 6/1991 | Perry | 454/35 |
| 5,402,613 | A | | 4/1995 | Giumenta et al. | |
| 5,715,808 | A | * | 2/1998 | Wilhoite | 126/85 B |
| 6,022,269 | A | | 2/2000 | Arbucci | |
| 6,029,655 | A | * | 2/2000 | Hussong et al. | 126/515 |
| 6,039,041 | A | | 3/2000 | Barth | |
| 6,073,418 | A | * | 6/2000 | Carroll | 52/746.11 |
| 6,484,712 | B1 | * | 11/2002 | Lyons et al. | 126/85 B |
| 6,926,600 | B1 | | 8/2005 | Arnold, Jr. | |
| 7,014,555 | B1 | * | 3/2006 | Issod | 454/44 |
| 2006/0249142 | A1 | * | 11/2006 | Bibaud et al. | 126/312 |

FOREIGN PATENT DOCUMENTS

| | | |
|---|---|---|
| CA | 2 448 369 | 5/2004 |

OTHER PUBLICATIONS

"Direct Vent Kits—LINK-DV30B, LINK-DV4-30B Installation Instruction", Hearth Technologies, Inc., page 649-921C (Oct. 2002).
U.S. Appl. No. 29/223,901, entitled "Chimney Cap", filed Feb. 22, 2005, now pending.

* cited by examiner

*Primary Examiner* — Kang Hu
*Assistant Examiner* — Samantha Miller
(74) *Attorney, Agent, or Firm* — Fredrikson & Byron, P.A.

(57) ABSTRACT

A chimney cap includes an intake pipe extension and an exhaust pipe extension; each extension includes an opening, the exhaust opening being disposed above the intake opening. The cap further includes solid sidewalls surrounding the intake opening and a diffusion plate disposed over the intake opening and below the exhaust opening.

23 Claims, 7 Drawing Sheets

CHIMNEY CAP

TECHNICAL FIELD

The present invention pertains to chimney caps and more particularly to chimney caps for vented gas appliances.

BACKGROUND

Gas fired appliances, for example gas fireplaces, include exhaust vents, which are often coupled with fresh air intakes. Exhaust and intake ducts or pipes may be routed from the appliance upward, through a chimney or a chase, to terminate on an exterior of a building, which houses the appliance. At this termination, the exhaust and intake pipes may extend, or be extended, side-by-side or coaxially into a chimney cap. These caps, which surround the external openings of exhaust and intake pipes, are typically designed to separate the exhaust from the fresh air intake, to control air flow, and to be aesthetically pleasing.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention.

Figure 1:
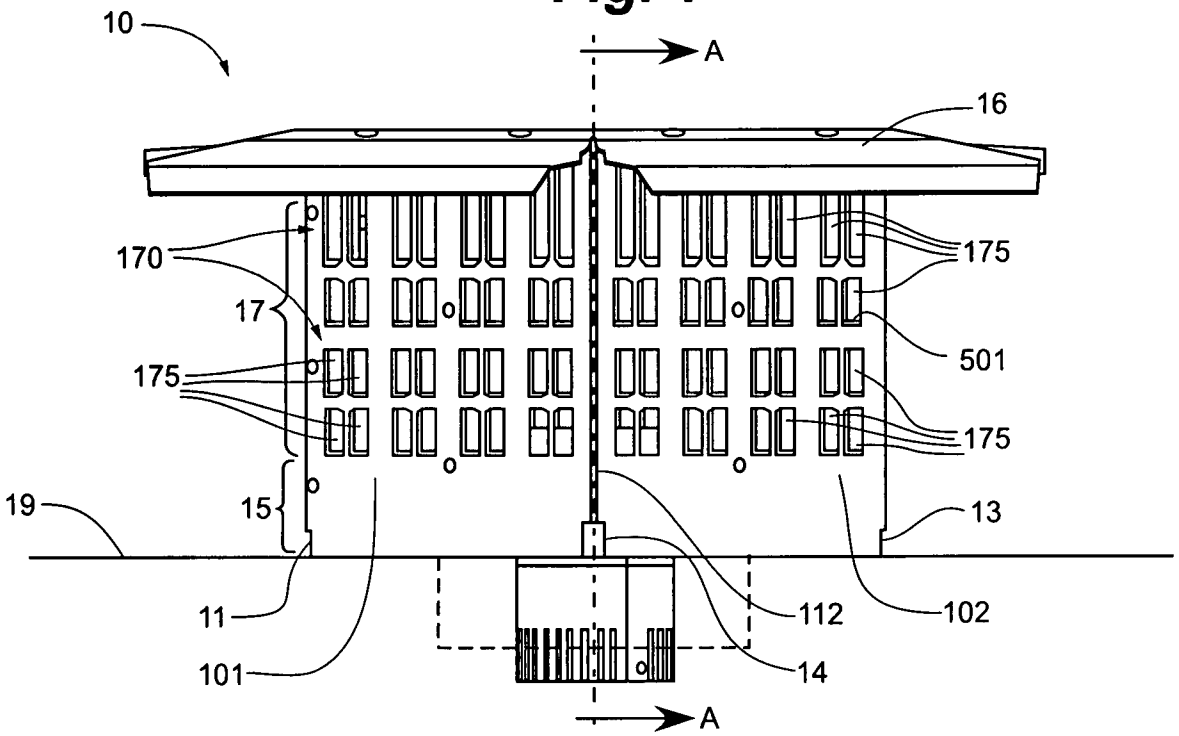
FIG. 1 is an elevation view of a chimney cap according to some embodiments of the present invention
Figure 2A:
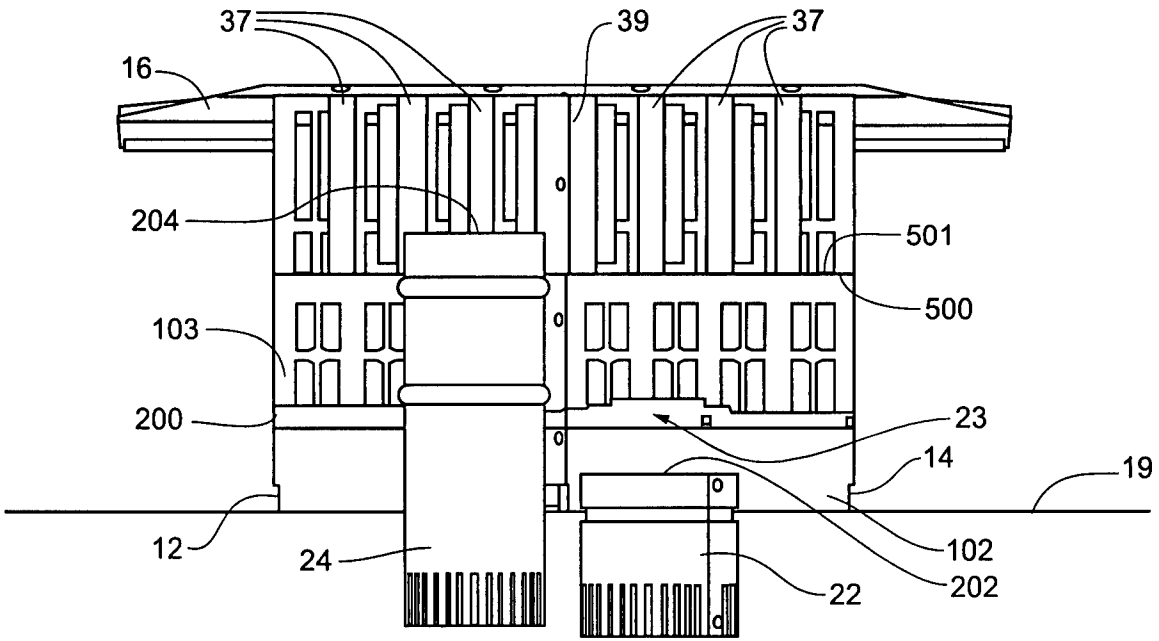
FIG. 2A is a cross-sectional view through section line A-A of FIG. 1, according to one embodiment of the present invention.
Figure 2B:
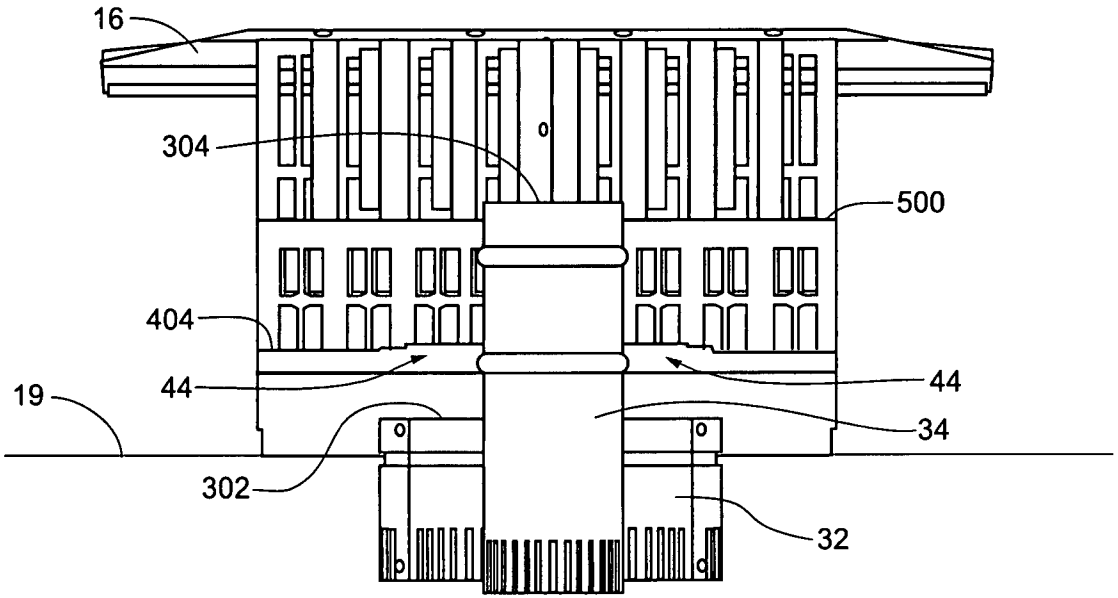
FIG. 2B is a cross-sectional view through section line A-A of FIG. 1, according to another embodiment of the present invention.

FIG. 1 is an elevation view of a chimney cap 10 according to some embodiments of the present invention; and FIGS. 2A-B are cross-sectional views through section line A-A of FIG. 1, each according to an alternate embodiment. Although the scope of the present invention is not limited by materials or construction methods, chimney cap 10 is preferably formed, in its entirety, from aluminum sheet metal according to forming methods well known to those skilled in the art. FIGS. 1 and 2A-B illustrate cap 10 including a sidewall, for example formed by flat sidewall segments 101, 102, 103 and 104 (segment 104 only seen in FIG. 5); the sidewall is topped by a roof 16 and mounted on flashing or a base plate 19. It should be noted that, although the sidewall illustrated herein includes flat sidewall segments 101, 102, 103, 104, the invention is not so limited by the number of sidewall segments or by the contour of the sidewall; for example, an alternate embodiment could include a curved sidewall in the form of a cylinder. The sidewall surrounds a fresh air intake pipe extension 22 (FIG. 2A) or 32 (FIG. 2B) and an exhaust pipe extension 24 (FIG. 2A) or 34 (FIG. 2B), which each extend through base plate 19 to respective openings 202, 302 and 204, 304. FIG. 2A illustrates an embodiment wherein intake pipe extension 22 and exhaust pipe extension 24 extend side-by-side, whereas FIG. 2B illustrates another embodiment wherein exhaust pipe extension 34 extends coaxially within intake pipe extension 32. FIGS. 2A-B further illustrate exhaust opening 204, 304 disposed above an upper plate 500 and intake opening 202, 302 disposed below upper plate 500 and below a corresponding diffusion plate 200, 400.

According to the illustrated embodiments, each sidewall segment 101, 102, 103, 104 includes a solid portion 15 and a perforated portion 17, which includes a plurality of windows 170 formed therethrough, and wherein each window 170 includes four apertures 175. Solid portion 15 is shown extending between base plate 19 and diffusion plate 200, 400 to shield intake opening 202, 302 from cross drafts, and perforated portion 17 is shown extending above diffusion plate 200, 400, allowing air to enter within the sidewall above diffusion plate 200, 400, and above upper plate 500. It should be noted that the scope of the present invention is not limited to the shape and arrangement of apertures 175 shown in the Figures, and a variety of other shapes and arrangements are possible for alternate embodiments of the present invention. It may be appreciated, with reference to FIGS. 3-4B, that diffusion plate 200, 400 allows air that enters through windows 170, which are below upper plate 500, to pass through to the corresponding intake opening 202, 302.

FIGS. 1 and 2A-B further illustrate lower openings 11, 12, 13, and 14 disposed adjacent base plate 19 at each corner, where each of the sidewall segments 101, 102, 103, 104 mate with one another. Openings 11, 12, 13, 14, which extend from an inside of each corner to an outside of or each corner, may prevent water, which can enter in through perforated portion 17 of the sidewall and then pass through diffusion plate 200, 400, from accumulating within the sidewall on base plate 19. Alternate embodiments of the present invention may include lower openings, which extend from the inside to the outside of the sidewall, being disposed elsewhere along the sidewall, at or near a base of the sidewall. With further reference to FIGS. 1 and 2A-B it may be seen that an upper surface 501 of upper plate 500 is disposed slightly above a lower edge of adjacent apertures 175; according to the illustrated embodiment, the position of upper surface 501 can allow water and debris to flow out from the adjacent apertures so that water and debris do not accumulate on upper plate 500.

Figure 3:
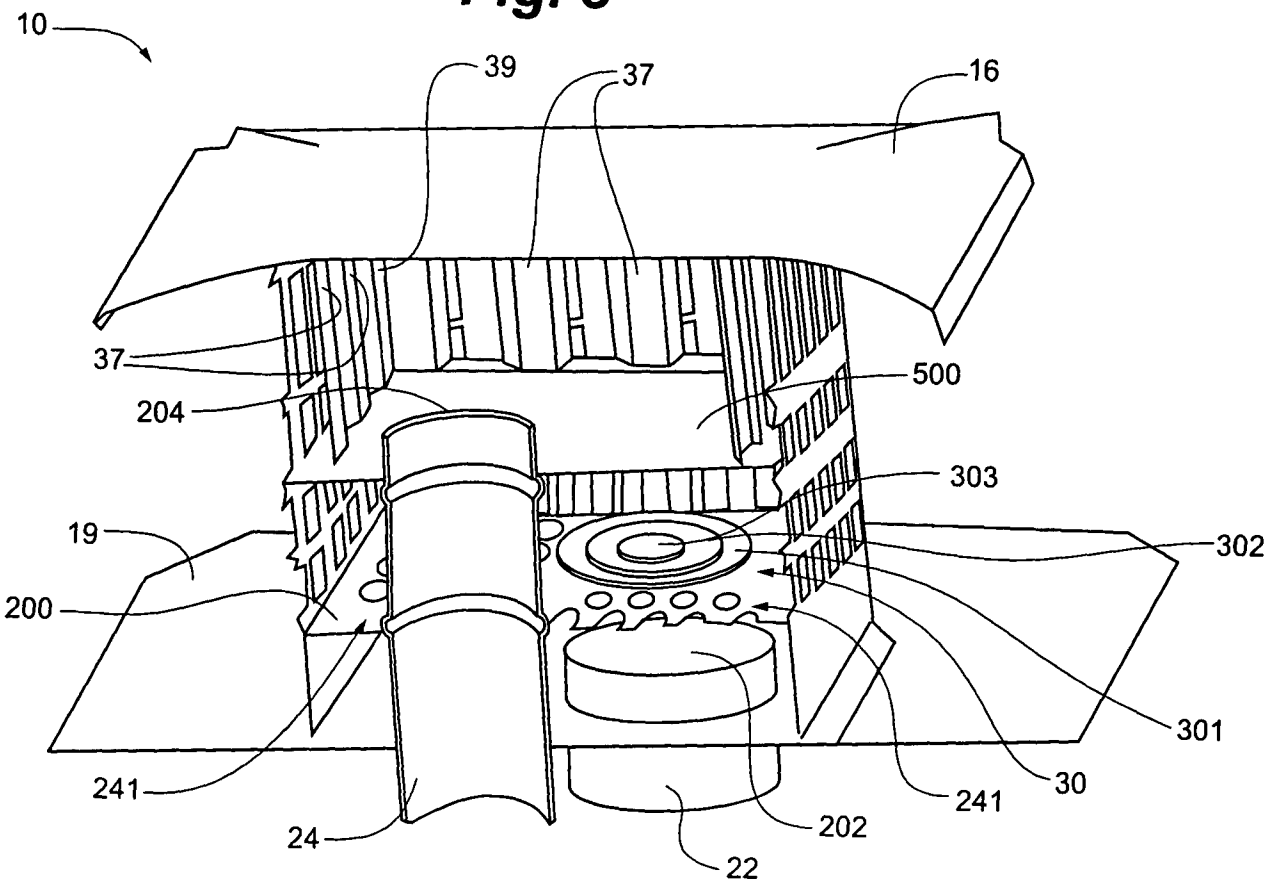
FIG. 3 is a perspective sectional view of the chimney cap of FIG. 1, according to the embodiment of FIG. 2A.
Figure 4A:
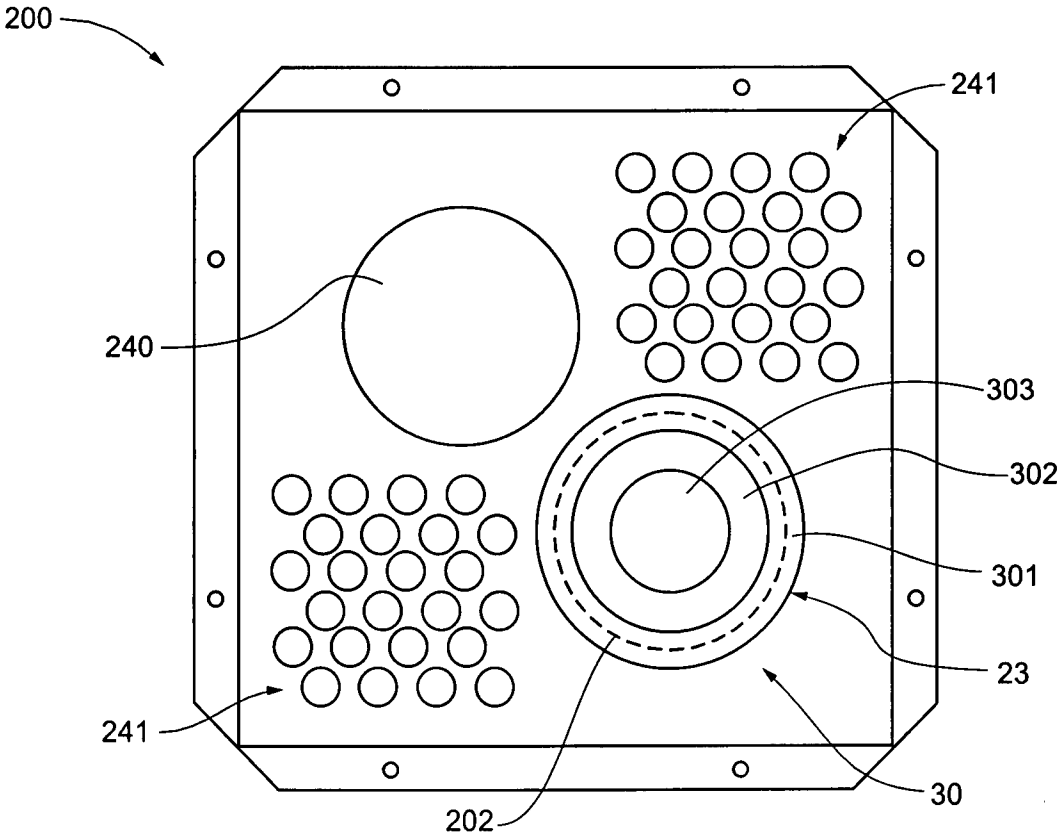
FIG. 4A is a plan view of a diffusion plate for a chimney cap, according to one embodiment of the present invention.

FIG. 3 is a perspective sectional view of the chimney cap of FIG. 1, according to the embodiment of FIG. 2A; and FIG. 4A is a plan view of diffusion plate 200. FIGS. 3 and 4A illustrate diffusion plate 200 including two groups of perforations 241, each laterally offset from a solid wall portion 30 and disposed in an opposing corner area of plate 200 on either side of solid wall portion 30. FIG. 4A further illustrates plate 200 including an opening 240, which is disposed adjacent to perforations 241 and solid wall portion 30, to allow passage of exhaust pipe extension 24 through plate 200. According to the illustrated embodiment, perforations 241 allow airflow therethrough and solid wall portion 30 prevents water and debris from flowing or dropping into intake opening 202, being positioned so as to extend directly over an entire area of intake opening 202 (FIGS. 2A and 3). A sum of the areas of all perforations 241 may be approximately equal to an area of intake opening 202.

Figure 4B:
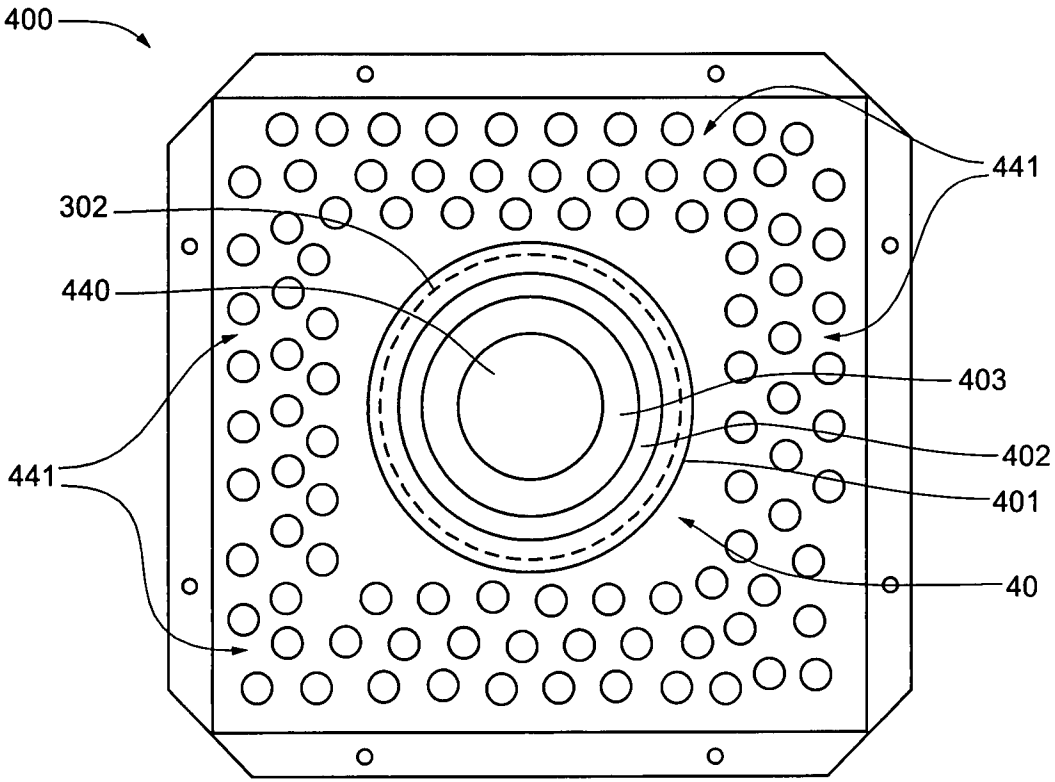
FIG. 4B is a plan view of a diffusion plate for a chimney cap, according to another embodiment of the present invention.

FIG. 4B is a plan view of diffusion plate 400 previously introduced for the embodiment illustrated in FIG. 2B. FIG. 4B illustrates diffusion plate 400 including a group of perforations 441 disposed about a peripheral portion of plate 400 and surrounding a solid wall portion 40, which in turn surrounds an opening 440, which allows passage of exhaust pipe 44 through plate 400. According to the illustrated embodiment, perforations 441 allow airflow therethrough and solid wall portion 40 prevents water and debris from flowing or dropping into intake opening 302, being positioned so as to extend directly over an entire area of intake opening 302 (FIG. 2B). A sum of the areas of all perforations 441 may be approximately equal to an area of intake opening 302.

Referring back to FIGS. 2A-B, it can be seen that a lower surface of each solid wall portion 30, 40 includes a recessed portion 23, 44, each of which are disposed over the corresponding intake opening 202, 302 and within a perimeter thereof. According to the illustrated embodiments, recessed portion 23, 44 may cause condensation forming on lower surface directly over the corresponding intake opening 202, 302, to flow along the lower surface, to a point outside the perimeter of the corresponding intake opening 202, 302, before dripping from the lower surface, so that the condensation does not drip into intake opening 202, 302. FIGS. 3 and 4A-B further illustrate recessed portion 23 and 44 formed by increasingly deep concentric circular indentations 301, 302, 303 and 401, 402, 403, respectively, which may be pressed into the lower surface of the corresponding plate 200, 400. However, it should be noted that recessed portion 23, 44 may be of any other form in alternate embodiments of the present invention, for example formed as a cone or a dome or as a segment of either.

Figure 5:
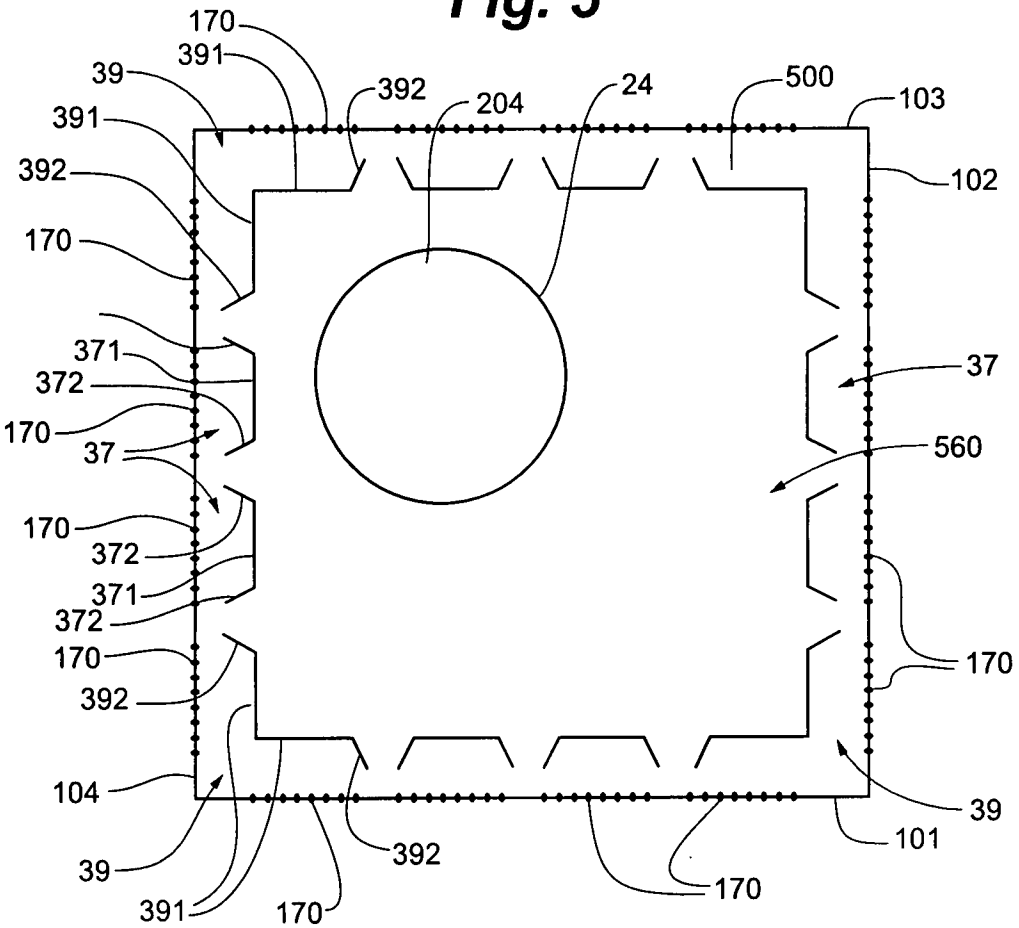
FIG. 5 is a top plan view of the chimney cap of FIGS. 1 and 2A, wherein a roof of the cap is removed.

FIG. 3 further illustrates baffles 37 and 39 mounted on upper plate 500 and being disposed along a peripheral portion of upper plate 500, between apertures 175 of the sidewall and exhaust opening 204, to control airflow over exhaust opening 204. FIG. 5 is a top plan view of chimney cap 10, wherein roof 16 is removed so that the arrangement of baffles 37 and 39 is more clearly shown. It should be noted that dotted lines in FIG. 5 schematically represent windows 170. FIG. 5 illustrates each baffle 37 including a first surface 371, which faces a corresponding window 170, and two side surfaces 372, each extending from an opposing edge of first surface 371 toward the corresponding window 170. Each side surface 372 is shown forming an obtuse angle with the first surface 371. FIG. 5 further illustrates baffles 39, which are each disposed at a corner of plate 500 and include a first surface 391 extending around the corner to face two windows 170, one on either side of the corner. Each of two side surfaces 392, of each baffle 39, are shown extending from an opposing edge of first surface 391, toward the corresponding window 170, and forming an obtuse angle with an adjacent portion of first surface 391. According to the illustrated embodiment, baffles 37, 39 are disposed in close proximity to windows 170 such that a relatively large void 560 is left around exhaust opening 204, thus an 'exhaust space' is maximized to allow for a more natural flow of exhaust out from exhaust opening. According to an exemplary embodiment, an area of exhaust opening is between approximately 20% and 25% of the area surrounded by baffles 37, 39. It should be noted that an alternate embodiment, which corresponds to that shown in FIG. 2B, includes baffles 37, 39 arranged as shown in FIG. 5 to surround exhaust opening 304, which is approximately centered over upper plate 500.

In the foregoing detailed description, the invention has been described with reference to specific embodiments. However, it may be appreciated that various modifications and changes can be made without departing from the scope of the invention as set forth in the appended claims.

The invention claimed is:

1. A chimney cap, comprising:

an intake pipe extension including an intake opening;

an upper wall including a lower surface, the lower surface comprising a recessed portion extending over an entire area of the intake opening and offset above the intake opening;

at least one sidewall completely surrounding a perimeter of the intake opening and being offset from the perimeter of the intake opening, wherein the at least one sidewall includes a solid portion and a perforated portion, wherein the perforated portion includes a plurality of apertures and the solid portion is free of a plurality of apertures, wherein the solid portion is the entire portion of the at least one sidewall that extends upward from the intake opening to a plane, the plane being approximately co-planar with the upper wall, and wherein the perforated portion extends upward from the plane; and an exhaust pipe extension including an exhaust opening disposed above the upper wall.

2. The chimney cap of claim 1, further comprising:

a base plate through which the intake pipe extension and the exhaust pipe extension extend upward and from which the at least one sidewall extends upward.

3. The chimney cap of claim 2, further comprising:

at least one lower opening disposed adjacent the base plate and extending from a first side of the at least one sidewall to a second side of the at least one sidewall.

4. The chimney cap of claim 1, wherein the at least one sidewall comprises a plurality of sidewall segments.

5. The chimney cap of claim 4, wherein the plurality of sidewall segments mate with one another at corners and further comprising:

a base plate through which the intake pipe extension and the exhaust pipe extension extend upward to the intake opening and the exhaust opening, respectively, and from which the plurality of sidewall segments extend upward.

6. The chimney cap of claim 5, further comprising:

a lower opening disposed adjacent the base plate at each of the corners extending from an inside of each corner to an outside of each corner.

7. The chimney cap of claim 1, wherein the upper wall defines a diffusion plate disposed above the intake opening, below the exhaust opening, and through which the exhaust pipe extension extends upward to the exhaust opening; the diffusion plate extending within the at least one sidewall and including a plurality of perforations laterally offset from a solid wall portion.

8. The chimney cap of claim 7, further comprising an upper plate disposed over the diffusion plate and through which the exhaust pipe extension extends upward to the exhaust opening.

9. The chimney cap of claim 8, further comprising a plurality of baffles mounted above the upper plate and surrounding the exhaust opening.

10. The chimney cap of claim 9, wherein the plurality of baffles are disposed along a peripheral portion of the upper plate.

11. The chimney cap of claim 1, wherein:

the upper wall defines a diffusion plate disposed over the intake opening and through which the exhaust pipe extension extends upward to the exhaust opening;

the diffusion plate including a plurality of perforations laterally offset from a solid wall portion; and an upper plate disposed over the diffusion plate and through which the exhaust pipe extension extends upward to the exhaust opening; the upper plate extending within the at least one sidewall.

12. The chimney cap of claim 11, further comprising:

a second plurality of apertures formed through the at least one sidewall above the upper plate and including at least one aperture extending below an upper surface of the upper plate.

13. A chimney cap, comprising:

an intake pipe extension including an intake opening;

an exhaust pipe extension including an exhaust opening disposed above the intake opening;

a base plate through which the intake pipe extension and the exhaust pipe extension extend upward to the intake opening and the exhaust opening, respectively;

at least one sidewall completely surrounding a perimeter of the intake pipe extension and the exhaust pipe extension and extending upward from the base plate, at least one lower opening disposed adjacent the base plate and extending from a first side of the at least one sidewall to a second side of the at least one sidewall;

a diffusion plate disposed over the intake opening, below the exhaust opening, and through which the exhaust pipe extension extends upward to the exhaust opening; and wherein the at least one sidewall includes a solid lower portion and a perforated upper portion, wherein the perforated portion includes a plurality of apertures and the solid portion is free of a plurality of apertures, wherein the solid lower portion is the entire portion of the at least one sidewall that extends from the intake opening to the diffusion plate and wherein the perforated upper portion extends above the diffusion plate.

14. The chimney cap of claim 13, further comprising an upper plate disposed over the diffusion plate and through which the exhaust pipe extension extends upward to the exhaust opening.

15. The chimney cap of claim 14, wherein the perforated upper portion extends above the diffusion plate and above the upper plate, wherein a first plurality of apertures is located between the diffusion plate and the upper plate and a second plurality of apertures is located above the upper plate.

16. The chimney cap of claim 15, wherein at least some of the second plurality of apertures extend below an upper surface of the upper plate.

17. The chimney cap of claim 13, wherein the at least one sidewall comprises a plurality of sidewall segments.

18. The chimney cap of claim 17, wherein the plurality of sidewall segments mate with one another at corners and the at least one lower opening is disposed at one of the corners.

19. A chimney cap, comprising:

an intake pipe extension including an opening;

an exhaust pipe extension including an opening disposed above the intake opening;

an upper plate disposed above the intake opening and through which the exhaust pipe extension extends upward to the exhaust opening;

at least one sidewall completely surrounding a perimeter of the intake pipe extension and the exhaust pipe extension and extending upward from the upper plate, the at least one side wall including a plurality of apertures disposed above the upper plate and about a perimeter thereof;

a diffusion plate disposed over the intake opening, below the upper plate, and through which the exhaust pipe extension extends upward to the exhaust opening;

a base plate through which the intake pipe extension and the exhaust pipe extension extend upward to the intake opening and the exhaust opening, respectively, the base plate disposed below the diffusion plate;

at least one lower opening disposed adjacent to the base plate and extending from a first side of the at least one sidewall to a second side of the at least one sidewall; and a plurality of baffles mounted above the upper plate and surrounding the exhaust opening, each baffle disposed adjacent to at least one aperture of the plurality of apertures.

20. The chimney cap of claim 19, wherein at least one of the plurality of apertures extends below an upper surface of the upper plate.

21. The chimney cap of claim 19, wherein each baffle includes a plurality of flat surfaces angled with respect to one another.

22. The chimney cap of claim 19, wherein the at least one sidewall further includes another plurality of apertures disposed below the upper plate and above the diffusion plate.

23. The chimney cap of claim 19, wherein the at least one sidewall comprises a plurality of sidewall segments.

* * * * *